US005211119A

United States Patent [19]

Tagawa et al.

[11] Patent Number: 5,211,119

[45] Date of Patent: May 18, 1993

[54] MAIN-PRESSER DRIVING APPARATUS FOR AUTOMATIC BINDING SEWING MACHINE

[75] Inventors: Yuji Tagawa, Nagoya; Takashi Kondou, Obu; Shigeru Abe, Kagamihara; Kazushi Inoue, Aichi, all of Japan

[73] Assignee: Brother Kogyo Kabushiki Kaisha, Nagoya, Japan

[21] Appl. No.: 955,273

[22] Filed: Oct. 1, 1992

[30] Foreign Application Priority Data

Oct. 8, 1991 [JP] Japan ..... 3-290878

[51] Int. Cl.[5] ..... D05B 19/00

[52] U.S. Cl. ..... 112/121.11; 112/113; 112/163; 112/114

[58] Field of Search ..... 112/121.11, 121.12, 112/104, 113, 147, 65, 68, 70, 121.15, 163, 167, 235, 114

[56] References Cited

U.S. PATENT DOCUMENTS

| | | | |
|---|---|---|---|
| 3,747,545 | 7/1973 | Nicolay et al. | 112/68 |
| 4,651,664 | 3/1987 | Bergvall | 112/121.11 X |
| 4,665,843 | 5/1987 | Goldbeck et al. | 112/68 |
| 5,092,258 | 3/1992 | Goldbeck et al. | 112/104 X |
| 5,109,785 | 5/1992 | Inoue et al. | 112/121.11 X |

FOREIGN PATENT DOCUMENTS 2-17563 5/1990 Japan .

*Primary Examiner*—Peter Nerbun

*Attorney, Agent, or Firm*—Oliff & Berridge

[57] ABSTRACT

A main-presser driving apparatus for an automatic binding sewing machine including two sewing needles for carrying out a binding sewing operation and a pair of main pressers for pressing a base cloth on which a binding cloth is to be sewn, the main pressers being supported by a frame of the sewing machine such that the two pressers are opposed to each other and are movable independently of each other along a directional line in which the two pressers advance toward, and retract away from, each other, the driving apparatus including a pair of drive devices each of which includes an actuator for displacing a corresponding one of the main pressers in the above-indicated direction independently of the other of the main pressers, each actuator being controllable to be stopped at a desired operational position; a needle distance specifying device specifying a distance between the two sewing needles; a control command producing device producing, based on the specified needle distance, a control command for each of the two actuators of said pair of drive means; and a control device driving each of the two actuators according to the produced control command and thereby displacing a corresponding one of the two main pressers along said directional line to a position corresponding to the produced control command.

18 Claims, 7 Drawing Sheets

MAIN-PRESSER DRIVING APPARATUS FOR AUTOMATIC BINDING SEWING MACHINE

BACKGROUND OF THE INVENTION

Field of the Invention

The present invention generally relates to a main-presser driving apparatus for an automatic binding sewing machine and particularly to such an apparatus which is capable of displacing each of opposed two main pressers independently of each other in a direction in which the two pressers advance toward, and retract away from, each other.

Related Art Statement

There is known an automatic binding sewing machine which carries out a full (or both-side) binding sewing operation, or a half (or one-side) binding sewing operation, for forming, e.g., a pocket. In the full binding sewing operation, the sewing machine sews, as shown in FIG. 3, a binding cloth W2 the opposite end portions of which are folded back to have a generally ring-like configuration, on a base cloth W1 by forming two arrays of stitches with two sewing needles. In the half binding sewing operation, the sewing machine sews a binding cloth which is folded in two, on a base cloth by forming an array of stitches on the binding cloth (superposed on the base cloth) with one of the two needles.

For switching the binding sewing machine between the full and half binding sewing operations, it is necessary to change the distance between the two main pressers (hereinafter, referred to as the "main-presser distance"), according to the selected one (full or half) of the binding sewing operations. Recently, there have been proposed various automatic binding sewing machines which have a pair of main pressers opposed to each other and both movable independently of each other in a direction in which the two pressers advance toward, and retract away from, each other, and which are capable of displacing each of the main pressers according to a selected sort of binding sewing operation.

An examined Japanese Utility Model Application published under Publication No. 2(1990)-17563 discloses an example of the above-indicated binding sewing machines. The disclosed sewing machine includes a left-hand and a right-hand base-cloth clamp (i.e., left-hand and right-hand main pressers) which are movable independently of each other by being driven by respective air cylinders, in a direction in which the two clamps advance toward, and retract away from, each other. The Japanese Document No. 2-17563 teaches using a recessed T-shaped binder for the full binding sewing operation and using a non-recessed T-shaped binder for the half binding sewing operation, and detecting by using a switch the presence or absence of a binder's recess so that the switch generates an ON/OFF signal. Based on the ON/OFF signal, the sewing machine identifies which one of the full and half binding sewing operations has been selected by an operator. The sewing machine is adapted to drive, or not to drive, each of the two air cylinders according to the identified binding sewing operation, so as to displace, or not to displace, each of the two clamps to a predetermined position.

However, in the above-indicated binding sewing machine, the switch only detects the presence or absence of a recess of a binder which is to be used, and generates an ON/OFF signal. Accordingly, the sewing machine identifies only which one of the full and half binding sewing operations is desired, and therefore can provide, as the main-presser distance, only one value for each of the two sorts of binding sewing operations. In addition, since the air cylinders are used for displacing the respective clamps or main pressers, the sewing machine cannot displace the main pressers with high accuracy to respective positions so as to have a predetermined main-presser distance. Furthermore, in the event that is changed the distance between two sewing needles used for carrying out the binding sewing operation, it is generally necessary to change the main-presser distance to a value corresponding to the changed needle distance. In the prior binding sewing machine, however, the main-presser distance has to be changed by manually adjusting the positions of the main pressers. Thus, in the prior machine, it is very cumbersome and time-consuming to change the main-presser distance, and consequently, width of the binding cloth to be sewn or bound on the base cloth.

SUMMARY OF THE INVENTION

It is therefore an object of the present invention to provide a main-presser driving apparatus for an automatic binding sewing machine, which apparatus is capable of accurately displacing, based on a specified distance between two sewing needles, two main pressers independently of each other in a direction in which the two pressers advance toward, and retract away from, each other, in the full or half binding sewing operation.

According to a first aspect of the present invention, there is provided a main-presser driving apparatus for an automatic binding sewing machine including two sewing needles for carrying out a binding sewing operation and a pair of main pressers for pressing a base cloth on which a binding cloth is to be sewn, the main pressers being supported by a frame of the sewing machine such that the two pressers are opposed to each other and are movable independently of each other along a directional line on which the two pressers advance toward, and retract away from, each other, the driving apparatus comprising (a) a pair of drive means each of which includes an actuator for displacing a corresponding one of the main pressers in the direction independently of the other of the main pressers, the actuator being controllable to be stopped at a desired operational position, (b) needle distance specifying means for specifying a distance between the two sewing needles, (c) control command producing means for producing, based on the specified needle distance, a control command for each of the two actuators of the pair of drive means, and (d) control means for driving the each of the two actuators according to the produced control command and thereby displacing a corresponding one of the two main pressers in the direction to a position corresponding to the produced control command.

In the main-presser driving apparatus constructed as described above, when the needle distance is specified, the two actuators are automatically driven according to the respective control commands, so that the two main pressers are displaced to respective positions to thereby change the distance between the two main pressers (i.e., main-presser distance). Thus, the present apparatus has eliminated the conventionally needed work to manually adjust the positions of the main pressers for changing the main-presser distance to a value corresponding to the specified (or changed) needle distance. This function can be used for each of the full and half binding sewing operations. In addition, the present apparatus employs the two actuators each of which is controllable to be stopped at a desired operational position. Accordingly, the two main pressers are displaced with high accuracy to respective desired positions. Thus, the present driving apparatus is free from all the above-identified problems with the prior binding sewing machine.

It is a second object of the present invention to provide a main-presser driving apparatus for an automatic binding sewing machine, which apparatus is capable of accurately displacing, based on inputted data indicative of a thickness of the binding cloth, two main pressers independently of each other in a direction in which the two pressers advance toward, and retract away from, each other, in the full or half binding sewing operation.

According to a second aspect of the present invention, there is provided a main-presser driving apparatus for an automatic binding sewing machine including two sewing needles for carrying out a binding sewing operation and a pair of main pressers for pressing a base cloth on which a binding cloth is to be sewn, the main pressers being supported by a frame of the sewing machine such that the two pressers are opposed to each other and are movable independently of each other along a directional line on which the two pressers advance toward, and retract away from, each other, the driving apparatus comprising (a) a pair of drive means each of which includes an actuator for displacing a corresponding one of the main pressers in the direction independently of the other of the main pressers, the actuator being controllable to be stopped at a desired operational position, (b) input means for inputting data related to a thickness of the binding cloth, (c) control command producing means for producing, based on the inputted thickness-related data, a control command for each of the two actuators of the pair of drive means, and (d) control means for driving the each of the two actuators according to the produced control command and thereby displacing a corresponding one of the two main pressers in the direction to a position corresponding to the produced control command.

The main-presser driving apparatus in accordance with the second aspect of the invention, enjoys the same advantages as those with the driving apparatus in accordance with the first aspect of the invention. In addition, since the data of the thickness of the binding cloth is utilized, the present driving apparatus displaces the two main pressers with higher accuracy to appropriate positions, so that the sewing machine provides a sewing product with higher quality.

BRIEF DESCRIPTION OF THE DRAWINGS

The above and optional objects, features and advantages of the present invention will be better understood by reading the following detailed description of the presently preferred embodiments of the invention when considered in connection with the accompanying drawings, in which.

DETAILED DESCRIPTION OF THE PREFERRED EMBODIMENT

Figure 1:
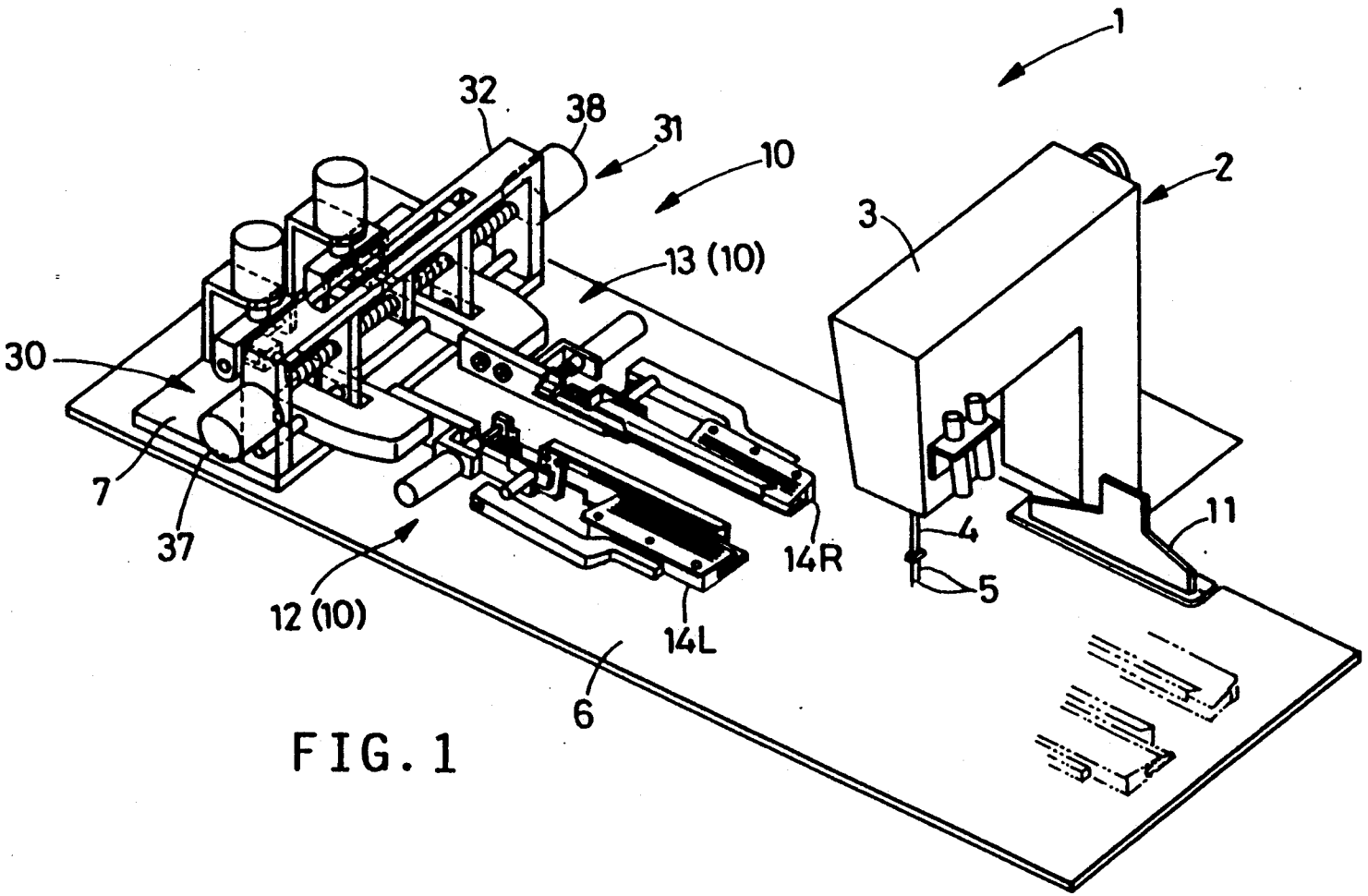
FIG. 1 is a perspective view of an automatic binding sewing machine to which the present invention is applied.

Referring first to FIG. 1 there is shown an automatic binding sewing machine 1 to which the present invention is applied. The binding sewing machine 1 is capable of performing a full binding sewing operation and two sorts of half binding sewing operations.

There will briefly be described the construction of the binding sewing machine 1. As shown in FIG. 1, the sewing machine 1 includes a sewing head 2 and a sewing table 6 which is stationary relative to the sewing head 2. The sewing head 2 has a horizontal arm 3 which is located above the sewing table 6 so as to extend parallel to the upper surface of the sewing table 6. The horizontal arm 3 supports a needle bar 4 which extends vertically. The needle bar 4 is vertically oscillatable by a needle-bar driving mechanism 55, 71 (FIG. 5) located inside the horizontal arm 3. A pair of sewing needles 5, 5 are attached to the lower end of the needle bar 4. Each sewing needle 5 is supplied with a needle thread. Beneath the sewing table 6, there are provided a pair of loop takers (not shown) each for taking the needle thread carried by a corresponding one of the two needles 5, 5.

Figure 2:
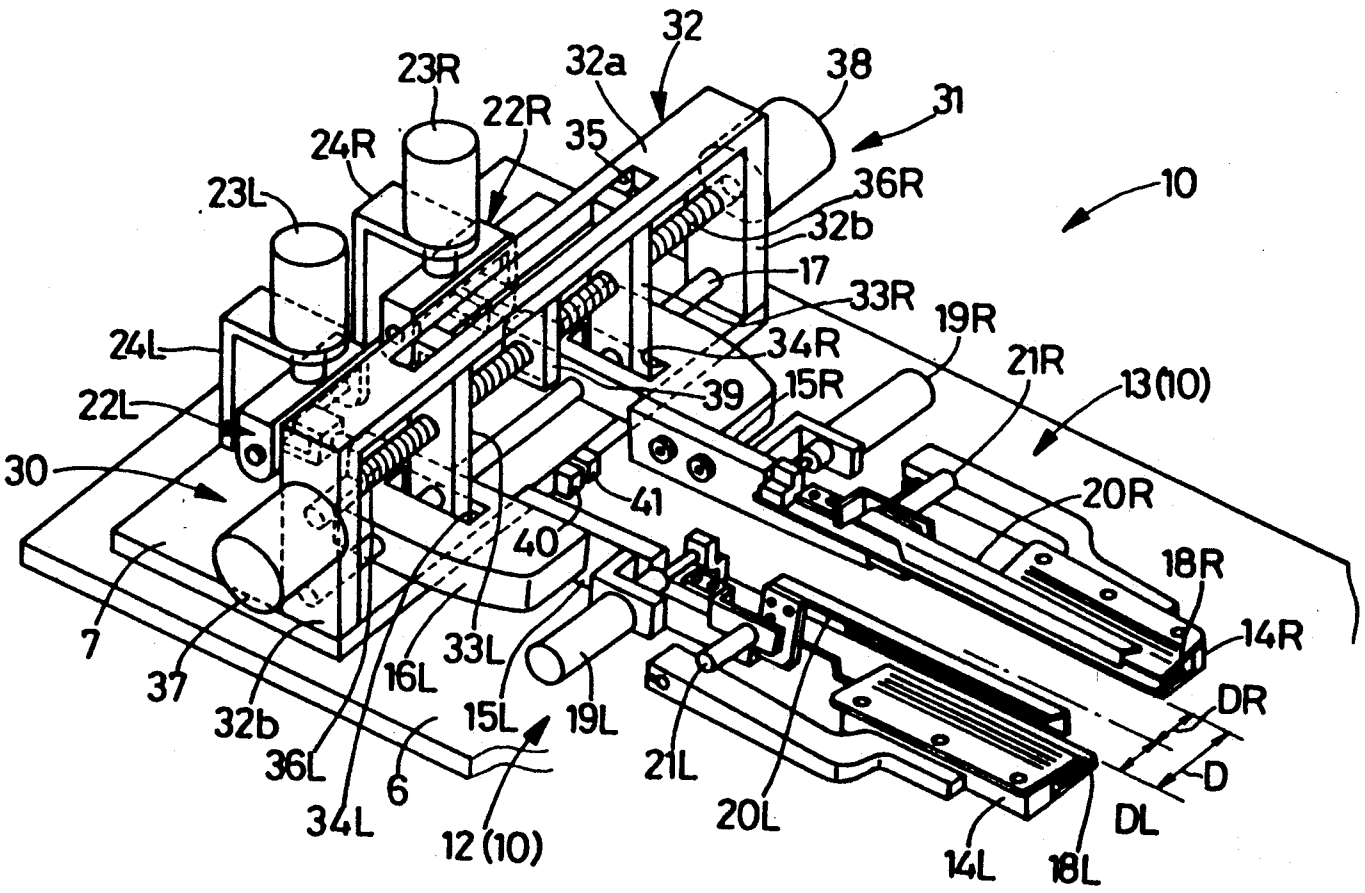
FIG. 2 is a perspective view of a clamping mechanism of the sewing machine of FIG. 1.
Figure 3:
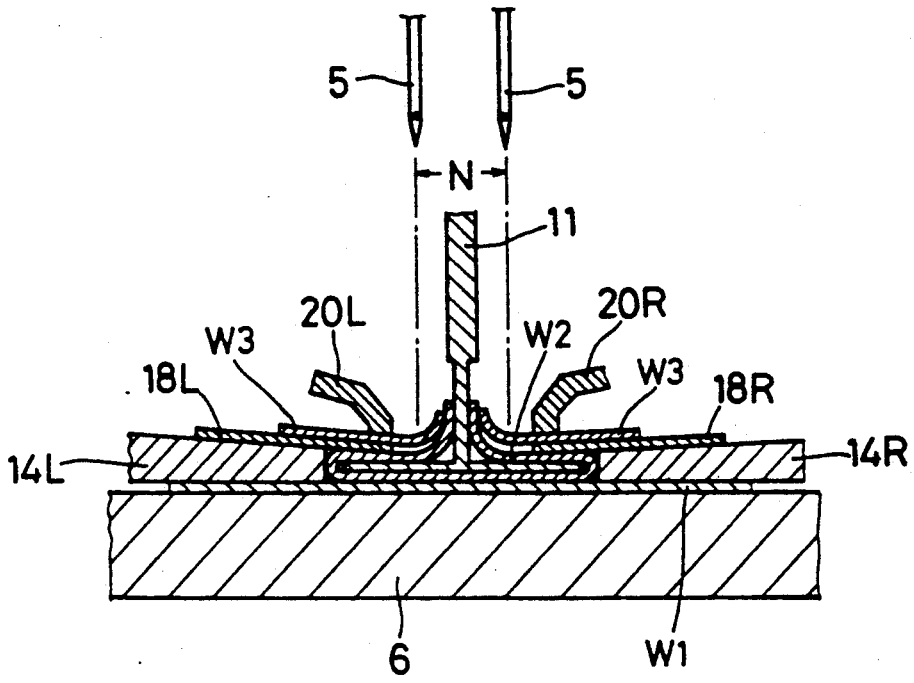
FIG. 3 is an elevation view in cross section of a part of the clamping mechanism of FIG. 2 located at the advanced position thereof.

Referring next to FIGS. 1 through 3, there will be described a clamping mechanism 10 provided on the sewing table 6 for clamping or pressing a base cloth W1 and a binding cloth W2 for the binding sewing operation.

The clamping mechanism 1 is driven independently of the sewing table 6 by a driving mechanism (not shown) so that the clamping mechanism 1 is movable between an advanced position thereof indicated in two-dot chain line in FIG. 1 and a retracted position thereof indicated in solid line. The clamping mechanism 1 is adapted to be stopped at a sewing position thereof below the sewing needles 5, 5 intermediate between the advanced and retracted positions thereof. A binder 11 having a generally inverted-T-shaped cross section is provided at the advanced position of the clamping mechanism 1. The binder 11 is driven by an elevator mechanism (not shown) so that the binder 11 is vertically movable between a bottom position thereof on the sewing table 6 and a top position thereof. The binder 11 shown in FIGS. 1 and 3 includes a web portion and symmetric two flange portions. This binder 11 is used for the full binding sewing operation. For the half binding sewing operations, the binder 11 is replaced by a different binder including asymmetrical two flange portions having a large and a small width, respectively. The clamping mechanism 10 include a first and a second clamping device 12, 13 whose constructions are symmetrical with each other. Hence, hereinafter, there will be described in detail only the first clamping device 12 provided on the side of the left-hand sewing needle 5 as viewed in FIG. 1.

The first clamping device 12 includes a main presser 14L for pressing the base cloth W1 against the sewing table 6. The main presser 14L is fixed at an end portion thereof to a support plate 15L which in turn is fixed to a pivotable member 16L. The pivotable member 16L is supported by a horizontally extending axis member 17 such that the pivotable member 16L is pivotable about, and axially movable on, the axis member 17. Thus, the pivotable member 16L is movable relative to the axis member 17 in the axial direction of the axis member 17. The axis member 17 is supported at opposite ends thereof by a pair of vertical side walls **32*b*, 32*b* of a frame member 32**.

The first clamping device 12 further includes a folding plate 18L for laterally folding back a corresponding one of opposite end portions of the binding cloth W2 superposed on the base cloth W1, according to the shape of the binder 11. The folding plate 18L is supported by the support plate 15L, and is connected at one end thereof to a piston rod of a first air cylinder 19L. When the first air cylinder 19L is driven to move the piston rod between an advanced and a retracted position thereof, the folding plate 18L is displaced between an operative position thereof at which the folding plate 18L folds back the binding cloth W2, and an inoperative position thereof at which the folding plate 18L is spaced away from the binding cloth W2.

The first clamping device 12 further includes a flap presser 20L for pressing a flap cloth W3 superposed on the left-hand half portion of the folded binding cloth W2, against the folding plate 18L. The flap presser 20L is supported by the support plate 15L, and is connected at one end thereof to a piston rod of a second air cylinder 21L. When the second air cylinder 21L is driven to move the piston rod between an advanced and a retracted position thereof, the flap presser 21L is displaced between an operative position thereof at which the flap presser 21L presses the flap cloth W3, and an inoperative position thereof at which the flap presser 21L is spaced away from the flap cloth W3.

Thus, a pair of main pressers 14L, 14R, a pair of folding plates 18L, 18R, and a pair of flap pressers 21L, 21R are provided such that the two members of each pair (14L, 14R), (18L, 18R), (21L, 21R) are opposed to each other.

The pivotable member 16L is connected through a connecting mechanism 22L to a piston rod of a third air cylinder 23L, which is fixed to a mount plate 24L secured to a base plate 7. When the third air cylinder 23L is driven to move the piston rod between an advanced and a retracted position thereof, the first clamping device 12 is pivoted about the axis member 17 to move upwardly.

The clamping mechanism 10 further includes a first and a second driving device 30, 31 for displacing the first and second clamping devices 12, 13 (or left-hand and right-hand main pressers 14L, 14R), respectively, along a directional line on which the two clamping devices 12, 13 advance toward, and retract from, each other. Since the first and second driving devices 30, 31 have symmetrical constructions, there will be described in detail only the first driving device 30.

The above-described frame member 32 is fixed to the base plate 7, which is provided on the sewing table 6. The frame member 32 includes a horizontal top wall **32*a* in addition to the opposite vertical side walls 32*b*, 32*b*, so that the frame member 32 has a generally inverted-U-shaped configuration. A movable vertical plate 33L is fitted at a bottom portion thereof in an elongate recess 34L formed in the pivotable member 16L, and is fitted at a top portion thereof in a longitudinal slit 35 formed in the top wall 32*a* of the frame member 32. The axis member 17 extends through the bottom portion of the vertical plate 33L**.

A horizontal feed screw 36L is threadedly engaged with the vertical plate 33L. The feed crew 36L is connected at one of opposite ends thereof to an output axis of a first motor 37 and is rotatably supported at the other end thereof by a stationary vertical plate 39, which is fixed to the top wall **32*a* of the frame member 32. When the first motor 37 is driven, the feed screw 36L is rotated, so that the vertical plate 33L is displaced in the axial direction of the axis member 17. Therefore, the pivotable member 16L and consequently the main presser 14L are displaced (translated) in the axial direction of the axis member 17, because of the engagement of the vertical plate 33L with the recess 34L of the pivotable member 16L. Likewise, when the second motor 38 is driven, the main presser 14R is displaced (translated) in the axial direction of the axis member 17. In the present embodiment, the first and second motors 37, 38** are stepper motors, respectively.

At the advanced position of the clamping mechanism 10 indicated in two-dot chain line in FIG. 1, the pair of main pressers 14L, 14R press the base cloth W1 against the sewing table 6 and thereby clamp the base cloth W1. Thereafter, the binder 11 is lowered to the bottom position thereof so as to press the binding cloth W2 against the base cloth W1. Next, the pair of folding plates 18L, 18R are displaced toward each other to the advanced positions thereof, so as to laterally fold back the binding cloth W2. Furthermore, a pair of flap cloths W3, W3 are superposed on the folded binding cloth W2 through the folding plates 18L, 18R, and the pair of flap pressers 21L, 21R press the flap cloths W3, W3, respectively, against the binding cloth W2 through the folding plates 18L, 18R. Subsequently, the clamping mechanism 10 clamping the base cloth W1, binding cloth W2 and flap cloths W3, W3, is displaced from the advanced position thereof, to the sewing position thereof below the sewing needles 5, 5, at which the cloths W1, W2, W3 are sewn on one another while the cloths W1, W2, W3 are fed and consequently the binder 11 comes out of the cloths.

The base plate 7 supports at one side-wall surface thereof a first sensor 40 for identifying whether the left-hand main presser 14L has reached a predetermined initial position thereof, and a second sensor 41 for identifying whether the right-hand main presser 14R has reached a predetermined initial position thereof. In the present embodiment, the two main pressers 14L, 14R have a common initial position, that is, innermost position indicated in one-dot chain line in FIG. 2. In addition, the first and second sensors 40, 41 are proximity switches for identifying that the corresponding main pressers 14L, 14R have reached the initial positions, by detecting the corresponding support plates 15L, 15R. With the main pressers 14L, 14R being located at the initial positions thereof, the distance, D, between the main pressers 14L, 14R (corresponding to the width of the folded binding cloth W2) is zero. Hereinafter, the distance D is referred to as the "presser distance D". In addition, the distance of the main presser 14L from the initial position thereof is referred to as the "left presser distance DL", while the distance of the main presser 14R from the initial position thereof is referred to as the "right presser distance DR". Therefore, the presser distance D is the addition of the left and right presser distances DL, DR.

Figure 4:
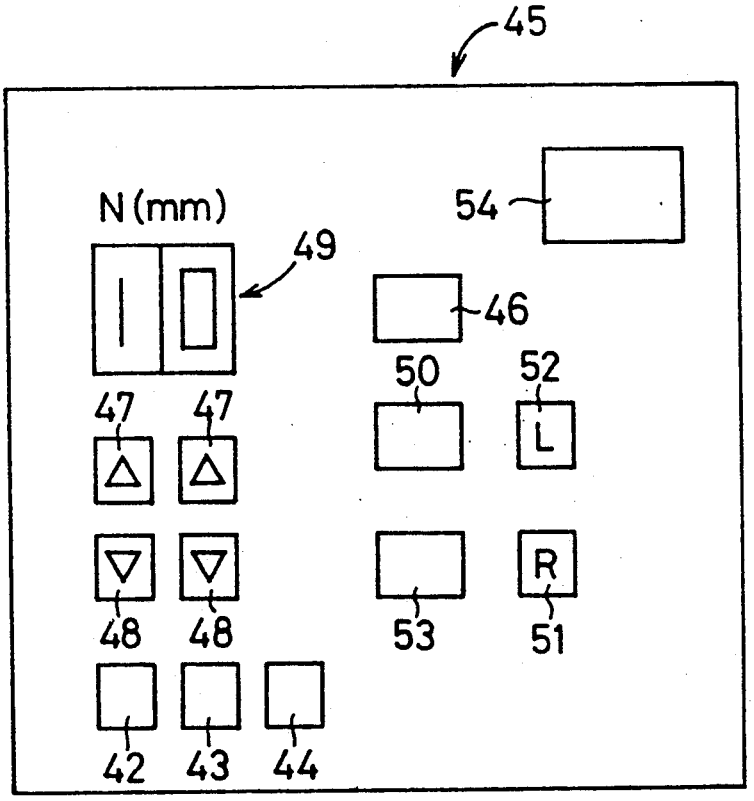
FIG. 4 is a front view of an operator panel of the sewing machine of FIG. 1.

The present sewing machine 1 includes an operator panel 45 as shown in FIG. 4. The operator panel 45 has a start key 46 for initiating the operation of inputting a distance, N, (unit: mm) between the two sewing needles 5, 5, and an end key 53 for terminating this operation and thereby establishing the needle distance N. The needle distance N is illustrated in FIG. 3. The panel 45 additionally has two increment keys 47 and two decrement keys 48 for specifying the needle distance N in two digits, and a display 49 for displaying the specified two-digit needle distance N. The panel 45 further has a first key 50 for selecting a full binding sewing mode, a second key 51 for selecting a right-hand half binding sewing mode, a third key 52 for selecting a left-hand half binding sewing mode, and a power switch 54.

Figure 5:
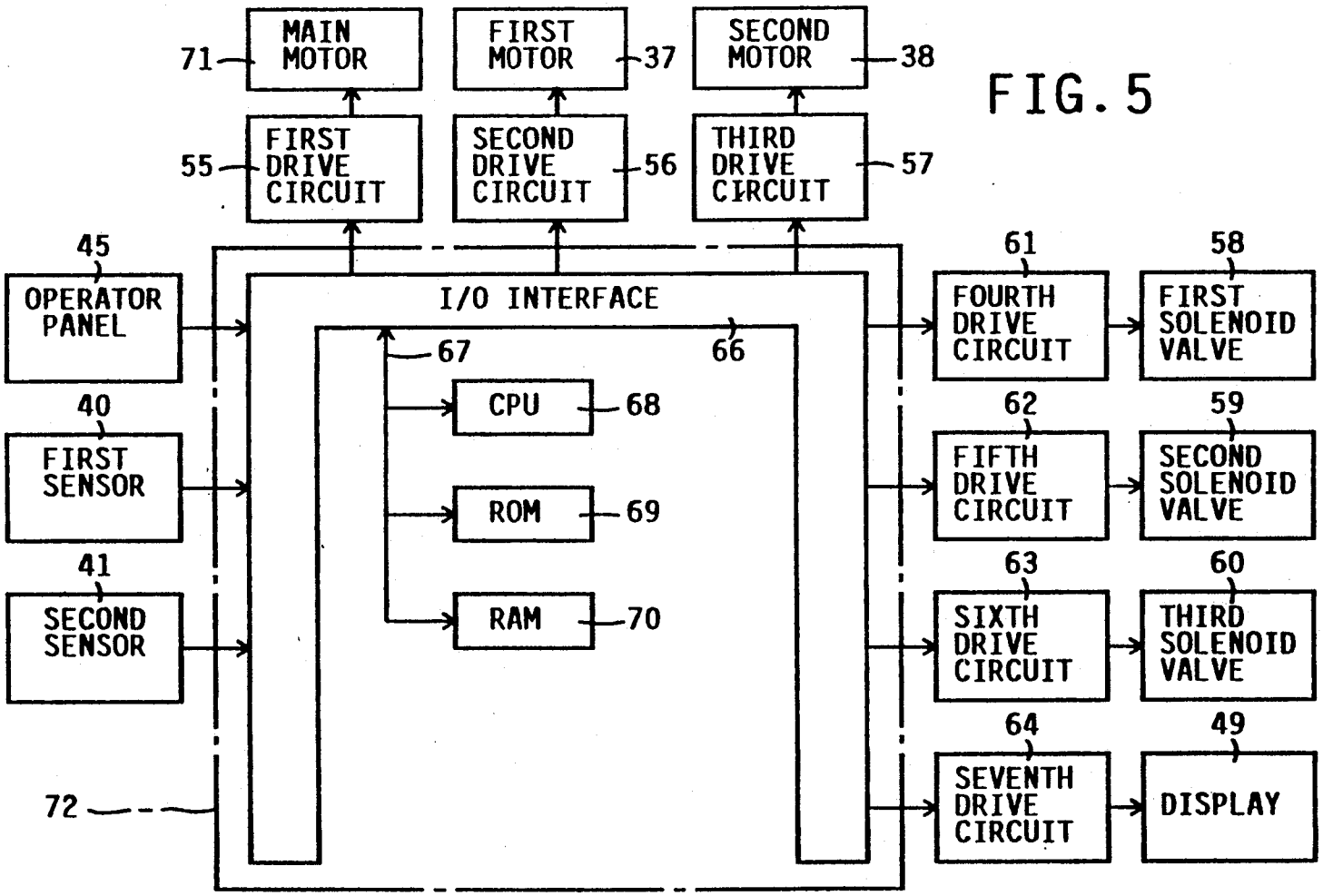
FIG. 5 is a diagrammatic view of the control circuit of the sewing machine of FIG. 1.

FIG. 5 shows the control circuit of the automatic binding sewing machine 1. The sewing machine 1 includes a control device 72. The control device 72 is connected via an input/output (I/O) interface 66 to (a) the operator panel 45; (b) the first sensor 40; (c) the second sensor 41; (d) a first drive circuit 55 for a main motor 71 which drives the needle bar 4; (e) a second drive circuit 56 for the first motor 37; (f) a third drive circuit 57 for the second motor 38; (g) a fourth drive circuit 61 for a first solenoid valve 58 which drives the first cylinders 19L, 19R; (h) a fifth drive circuit 62 for a second solenoid valve 59 which drives the second cylinders 21L, 21R; (i) a sixth drive circuit 63 for a third solenoid valve 60 which drives the third cylinders 23L, 23R; and a seventh drive circuit 64 for the display 49.

The control device 72 consists essentially of a central processing unit (CPU) 68, a read only memory (ROM) 69, and a random access memory (RAM) 70. The ROM 69 and RAM 70 each are connected to the CPU 68 through bus 67 including data bus.

The ROM 69 stores various control programs including programs for driving the motors 37, 38, 71 and programs for driving the solenoid valves 58, 59, 60, and the main-presser drive program which will be described in detail later. The RAM 70 includes (a) a binding sewing data memory for storing the selected one of the full, right-hand half, and left-hand half binding sewing modes, and the specified value of the needle distance N; (b) a presser-distance data memory for storing calculated values of the left and right presser distances DL, DR; and other memories for temporarily storing the results of calculation of the CPU 68.

Figure 6:
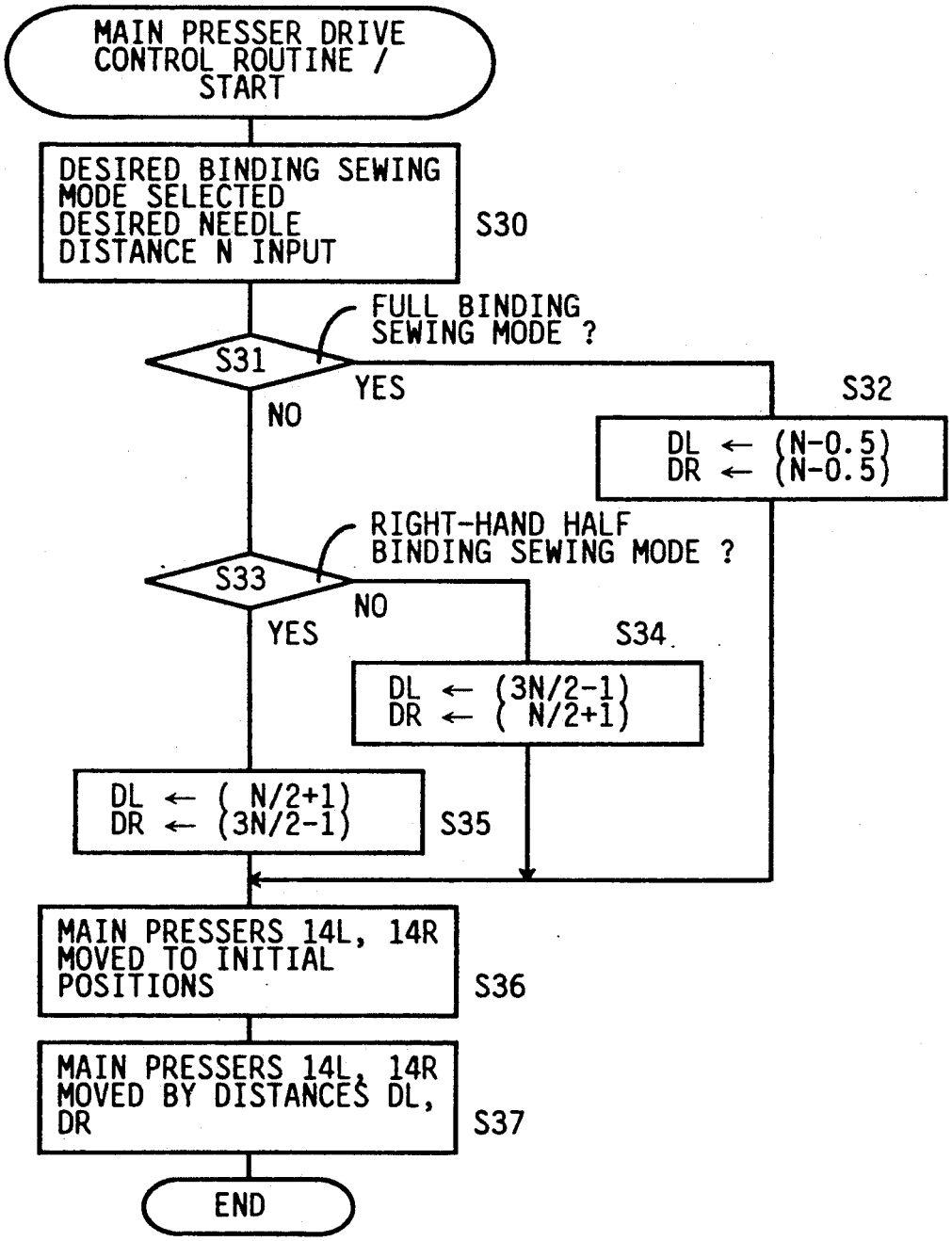
FIG. 6 is a flow chart representing the main-presser drive routine carried out by a control device of the sewing machine of FIG. 1.

There will be described the main-presser drive operation carried out by the sewing machine 1, by reference to the flow chart of FIG. 6.

Upon operation of the start key 46 on the operator panel 45, the control of the CPU 68 of the control device 72 begins with Step S30 in which the needle distance N (mm) is specified by operating the increment and decrement keys 47, 48, and one of the full, right-hand half, left-hand half binding sewing modes is selected by operating a corresponding one of the first to third keys 50, 51, 52. These data are stored in the binding sewing data memory of the RAM 70. A more or less suitable binder 11 is selected for the specified needle distance N and the selected binding sewing mode.

Upon operation of the end key 53, the control of the CPU 68 proceeds with Step S31 to identify whether or not the full binding sewing mode has been selected, based on the data stored in the binding sewing data memory. If an affirmative judgement ("Yes") is made in Step S31, the control goes to Step S32 to calculate each of the left and right presser distances DL, DR by subtracting a predetermined standard value, 0.5 mm, from the needle distance N and store the calculated values DL, DR in the presser distance data memory of the RAM 70.

The above-indicated standard value 0.5 mm is predetermined so as to permit the binder 11 to smoothly come out of the cloths W1, W2 (and W3) when the clamping mechanism 10 carries the cloths W1, W2, W3 from the advanced position thereof to the sewing position thereof. Meanwhile, after an elongate center cut has been formed through the thickness of the clothes W1, W2 so as to extend between, and parallel to, the two arrays of stitches made by the two needles 5, 5 for the full binding sewing operation and a pair of corner cuts have been formed so as to extend from each of opposite ends of the center cut, the binding and flap cloths W2, W3 are turned into the opposite side of the base cloth W1 through the formed cuts. The standard value 0.5 mm is also pre-determined such that the opposite folded ends of the binding cloth W2 are substantially aligned with each other when the cloths W2, W3 are turned into the opposite side of the base cloth W1. This value can be changed by operating three keys 42, 43, 44 provided on the operator panel 45. More specifically, in the event that a thicker binding cloth W2 is used, the first adjusting key 42 may be operated to change the standard value 0.5 mm, to a smaller value, zero mm. Meanwhile, in the event that a thinner binding cloth W2 is used, the second adjusting key 44 may be operated to change the standard value to a greater value, 1.0 mm. In order to restore the standard value, the "cancel" key 43 is operated. It is possible to provide more than three (e.g., eleven) keys for changing the standard value 0.5 mm by smaller increments or decrements of, e.g., 0.1 mm.

Step S32 is followed by Step S36 to operate the first and second motors 37, 38 for displacing the main pressers 14L, 14R to the initial positions thereof. That the first and second sensors 40, 41 have detected the support plates 15L, 15R, respectively, means that the main pressers 14L, 14R have reached the initial positions. When the main pressers 14L, 14R have reached the initial positions, that is, when the first and second sensors 40, 41 have detected the support plates 15L, 15R, respectively, the control device 72 or CPU 68 stops the first and second motors 37, 38, respectively. Thus, the control device 72 establishes respective initial operational positions of the first and second motors 37, 38 (i.e., stepper motors).

Step S36 is followed by Step S37 to operate the first and second motors 37, 38 by respective amounts corresponding to the left and right presser distances DL, DR stored in the presser distance data memory of the RAM 70. Thus, this routine is ended. As a result, the pair of main pressers 14L, 14R are positioned such that the two main pressers 14L, 14R are spaced from each other by the presser distance D corresponding to the selected full binding sewing mode and the inputted needle distance N.

However, it is possible to skip Step S36 in each of control cycles subsequent to the initial or first control cycle carried out following application of electric power to the present sewing machine. This may be achieved by storing the left and right presser distances DL, DR determined in each of the first and subsequent control cycles, and operating the first and second motors 37, 38 by using the stored values DL, DR in a control cycle following such each control cycle.

In the event that the left-hand half binding sewing mode is selected by operating the third key 52 on the operator panel 45, a negative judgement ("No") is made in each of Steps S31 and S33, and the control of the CPU 68 goes to Step S34 to calculate the left presser distance DL by the following formula: $DL=1.5N-1$, and calculate the right presser distance DR by the following formula: $DR=0.5N+1$. Subsequently, the control goes to Steps S36 and S37 to operate the first and second motors 37, 38 by respective amounts corresponding to the thus calculated left and right presser distances DL, DR. Consequently, the pair of main pressers 14L, 14R are positioned so as to be spaced from each other by the presser distance D corresponding to the selected left-hand half binding sewing mode and the specified needle distance N.

Likewise, in the event that the right-hand half binding sewing mode is selected by operating the second key 51 on the operator panel 45, a negative judgement is made in Step S31 and an affirmative judgement is made in Step S33, and the control of the CPU 68 goes to Step S35 to calculate the left presser distance DL by the following formula: $DL=0.5N+1$, and calculate the right presser distance DR by the following formula: $DR=1.5N-1$. Subsequently, the control goes to Steps S36 and S37 to operate the first and second motors 37, 38 by respective amounts corresponding to the thus determined left and right presser distances DL, DR. Thus, the pair of main pressers 14L, 14R are positioned so as to be spaced from each other by the presser distance D corresponding to the selected right-hand half binding sewing mode and the specified needle distance N.

In the left-hand or right-hand half binding sewing mode, the binding cloth W2 which is partially folded in two, is sewn on the base cloth W1 such that an array of stitches is formed on the two-folded portion of the cloth W2 with one (left-hand or right-hand) of the two needles 5, 5 and at the same time another array of stitches is formed on the non-folded portion of the cloth W2 with the other (right-hand or left-hand) needle 5. When the binding and flap cloths W2 and W3 are turned into the opposite side of the base cloth W1, the cloths W1, W2, W3 are folded at each array of stitches. However, it is possible to carry out the left-hand or right-hand half binding sewing operation, such that a binding cloth W2 properly folded in two, is sewn on the base cloth W1 by forming an array of stitches on the two-folded cloth W2 with the left-hand or right-hand needle 5 and at the same time forming another array of stitches directly on the base cloth W1 with the right-hand or left-hand needle 5. In the latter case, when the binding and flap cloths W2 and W3 are turned into the opposite side of the base cloth W1 through the center and corner cuts formed through the cloths W1, W2, the cloths W1, W2, W3 are folded at the left-hand or right-hand array of stitches and the base cloth W1 is folded at the right-hand or left-hand array of stitches, which serves for preventing the woven threads of the base cloth W1 from fraying from the cuts. Furthermore, it is possible to carry out the half binding sewing operation, such that a binding cloth W2 folded in two, is sewn on the base cloth W1 by forming an array of stitches on the two-folded binding cloth W2 with an appropriate one of the two needles 5, 5 and forming no stitch with the other needle 5 which has been removed before commencement of the half binding sewing operation.

It emerges from the foregoing description that, in the present automatic binding sewing machine, a presser distance D for a desired binding sewing operation is automatically determined by selecting a desired sort (full, left-hand half, or right-hand half) of binding sewing mode and specifying a desired needle distance N. More specifically, the left and right presser distances DL, DR for the left and right main pressers 14L, 14R are calculated by using respective predetermined mathematical formulae. The presser distance D corresponds to the width of the binding cloth W2 sewn on the base cloth W1. After the initial positions of the left and right main pressers 14L, 14R have been established, the first and second motors 37, 38 are driven by respective amounts corresponding to the determined left and right presser distances DL, DR. Thus, the two main pressers 14L, 14R are displaced with high accuracy to respective positions corresponding to the selected sort of binding sewing mode and the specified needle distance N, that is, to the desired presser distance D (or desired width of binding cloth W2). Therefore, irrespective of which sort of binding sewing mode is selected, the presser distance D is easily changed, without needing to manually adjust the positions of the main pressers 14L, 14R.

In the illustrated embodiment the initial positions of the left and right main pressers 14L, 14R coincide with each other at the innermost position shown in FIG. 2. However, the initial positions of the two main pressers 14L, 14R may have a clearance, S, therebetween. The clearance S may include an amount due to the original design of the sewing machine and/or an amount due to the errors of assembling of the sewing machine. Before being shipped from the manufacturer's factory, the clearance S of each sewing machine may be measured by stopping the motors 37, 38 at the time when the main pressers 14L, 14R being moved are detected by the sensors 40, 41, respectively. The thus measured distance S may be stored in the ROM 69, and the left and right presser distances DL, DR may be calculated according to predetermined mathematical formulae each incorporating the distance S as an adjusting factor.

Additionally, in the illustrated embodiment, the left and right presser distances DL, DR are calculated according to the predetermined mathematical formulae. However, the ROM 69 may be adapted to store a table which contains respective values of the left and right presser distances DL, DR corresponding to each of the three sorts of binding sewing modes and each of different values of the needle distance N. In this case, when a desired binding sewing mode is selected and a desired needle distance N is specified or inputted, the CPU 68 reads in the values DL, DR corresponding to the selected binding sewing mode and inputted needle distance N, from the ROM 69.

Furthermore, it is possible to modify the first and second drive mechanisms 30, 31 employed in the illustrated embodiment. For example, other rotary actuators such as servo motors, or linear actuators such as linear motors may be used as the first and second motors 37, 38.

Figure 7:
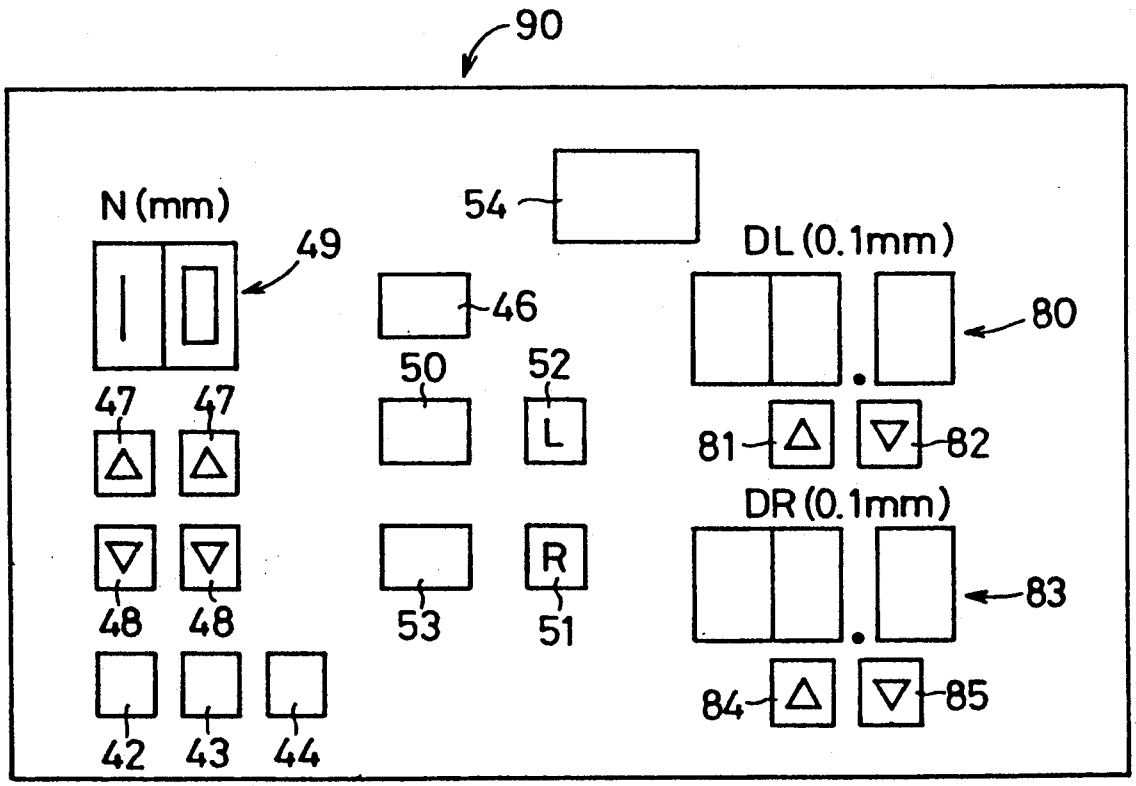
FIG. 7 is a front view of an operator panel as another embodiment of the present invention.

Referring next to FIG. 7, there is shown an operator panel 90 according to another embodiment of the present invention. The construction of the panel 90 is generally similar to that of the operator panel 45 of FIG. 4, but is different from the latter in that the former additionally has a left presser distance (DL) display 80, an increment and a decrement key 81, 82 for the display 80, a right presser distance (DR) display 83, and an increment and a decrement key 84, 85 for the display 83. The left presser distance display 80 indicates the calculated left presser distance DL, while the right presser distance display 83 indicates the calculated right presser distance DR. The increment and decrement keys 81, 82, 84, 85 are used for increasing or decreasing the values displayed on the display 80 or 83, by increments (or units) of 0.1 mm. In the present embodiment, the left and right presser distances DL, DR calculated by the control device 72 are finely adjusted by using the keys 81, 82, 84, 85, depending upon the thickness of the binding cloth W2 used and/or the thickness of the base cloth W1 used, for example. However, it is possible to adapt the increment and decrement keys 81, 82, 84, 85 to change the values displayed on the display 80 or 83 by greater increments or decrements of, e.g., 0.5 mm.

While the present invention has been described in its preferred embodiments, it is to be understood that the present invention may be embodied with various changes, improvements and modifications that may occur to those skilled in the art without departing from the scope and spirit of the invention defined in the appended claims.

What is claimed is:

1. A main-presser driving apparatus for an automatic binding sewing machine including two sewing needles for carrying out a binding sewing operation and a pair of main pressers for pressing a base cloth on which a binding cloth is to be sewn, the main pressers being supported by a frame of the sewing machine such that the two pressers are opposed to each other and are movable independently of each other along a directional line on which the two pressers advance toward, and retract away from, each other, the driving apparatus comprising:

a pair of drive means each of which includes an actuator for displacing a corresponding one of said main pressers along said directional line independently of the other of said main pressers, said actuator being controllable to be stopped at a desired operational position;

needle distance specifying means for specifying a distance between said two sewing needles;

control command producing means for producing, based on the specified needle distance, a control command for each of the two actuators of said pair of drive means; and control means for driving said each of the two actuators according to the produced control command and thereby displacing a corresponding one of said two main pressers along said directional line to a position corresponding to said produced control command.

2. A main-presser driving apparatus according to claim 1, wherein said needle distance specifying means comprises:

an initiating member operable for initiating the operation of specifying said needle distance;

at least one input member operable for inputting a value as said needle distance;

display means for displaying the inputted value; and a terminating member operable for terminating the operation of specifying said needle distance and thereby establishing as said needle distance the value displayed on said display means.

3. A main-presser driving apparatus according to claim 1, wherein said control command producing means comprises input means for inputting data related to a thickness of said binding cloth, said control command producing means producing said control command based on said specified needle distance and the inputted thickness-related data.

4. A main-presser driving apparatus according to claim 1, wherein said control command producing means produces said control command based on at least information about which one of a full binding sewing operation and a half binding sewing operation is to be carried out and said needle distance specified by said needle distance specifying means.

5. A main-presser driving apparatus according to claim 4, wherein said control command producing means calculates, when said full binding sewing operation is to be carried out, a position to which said each of said two main pressers is to be displaced, according to a following formula: $d=n+C$, wherein d is a distance from a middle point of said two sewing needles; n is said needle distance; and C is a constant, said control command producing means producing said control command for said each of the two actuators, based on said distance d.

6. A main-presser driving apparatus according to claim 4, wherein said control command producing means calculates, when said half binding sewing operation is to be carried out, respective positions to which said two main pressers are to be displaced, according to the following formulae: $d_1=A_1 \cdot n+B_1$ and $d_2=A_2 \cdot n+B_2$, wherein $d_1$ is a distance from a middle point of said two sewing needles, for one of said two main pressers which corresponds to said half binding sewing operation; $d_2$ is a distance from said middle point for the other of said two main pressers; n is said needle distance; and $A_1$, $A_2$, $B_1$, $B_2$ are constants, said control command producing means producing respective control commands for said two actuators, based on the said distances $d_1$, $d_2$.

7. A main-presser driving apparatus according to claim 1, wherein said control command producing means produces said control command based on at least information about which one of a full binding sewing operation and a half binding sewing operation is to be carried out and said needle distance specified by said needle distance specifying means, according to a prestored table containing respective control commands for said two actuators which commands correspond to each of said full and half binding sewing operations and each of different values of said needle distance.

8. A main-presser driving apparatus according to claim 1, wherein said control command producing means comprises:

determining means for determining, based on said specified needle distance, a position to which said each of said two main pressers is to be displaced; and modifying means for modifying the determined position of said each main presser, said control means driving the actuator corresponding to said each main presser so as to displace said each main presser to the modified position.

9. A main-presser driving apparatus according to claim 1, further comprising selecting means operable for selecting one of a full binding sewing operation and a half binding sewing operation.

10. A main-presser driving apparatus according to claim 9, wherein said selecting means comprises:

a first member operable for selecting said full binding sewing operation;

a second member operable for selecting a left-hand half binding sewing operation; and a third member operable for selecting a right-hand half binding sewing operation.

11. A main-presser driving apparatus according to claim 1, further comprising establishing means for establishing an initial position of each of said two main pressers, said control means driving each of said two actuators for displacing a corresponding one of said two main pressers from the initial position thereof by a distance corresponding to said produced control command.

12. A main-presser driving apparatus according to claim 11, wherein said establishing means comprises:

sensor means for detecting each of said two main pressers when said each main presser is displaced by a corresponding one of said two actuators; and stopping means for stopping said corresponding one actuator when said sensor means generates a detection signal indicating the detection of said each main presser.

13. A main-presser driving apparatus according to claim 1, the sewing machine further including a binder for pressing said binding cloth on said base cloth pressed by said two main pressers, said binder including a web portion and a pair of flange portions extending from said web portion, and accordingly having a generally inverted-T-shaped cross section; a pair of folding plates for folding back opposite end portions of said binding cloth onto said flange portions of said binder, respectively; a pair of flap pressers for pressing a pair of flap cloths on the folded binding cloth through said pair of folding plates, respectively; and a pair of support members each for supporting a corresponding one of said two main pressers, a corresponding one of said two folding plates, and a corresponding one of said two flap pressers, each of said pair of drive means displacing a corresponding one of said two support members.

14. A main-presser driving apparatus according to claim 13, the sewing machine further including an axis member for supporting said two support members such that each of said support members is pivotable about said axis member and is movable along said axis member, each of said pair of drive means including a lifting means for rotating a corresponding one of said two support members about said axis member and thereby moving up and down said corresponding one main presser, folding plate and flap presser altogether.

15. A main-presser driving apparatus according to claim 14, wherein each of said pair of drive means comprises:

an elongate recess formed in a corresponding one of said two support members so as to extend in a direction perpendicular to an axis line of said axis member;

a movable member fitted in said elongate recess such that said movable member is displaceable relative to said corresponding one support member in a plane perpendicular to said axis line of said axis member and is not displaceable in a direction parallel to said axis line of said axis member;

a feed screw extending parallel to said axis line of said axis member and threadedly engaged with said movable member, said feeding screw being rotatable about an axis line thereof and immovable in said direction parallel to said axis line of said axis member; and said actuator being provided for rotating said feed screw.

16. A main-presser driving apparatus for an automatic binding sewing machine including two sewing needles for carrying out a binding sewing operation and a pair of main pressers for pressing a base cloth on which a binding cloth is to be sewn, the main pressers being supported by a frame of the sewing machine such that the two pressers are opposed to each other and are movable independently of each other along a directional line on which the two pressers advance toward, and retract away from, each other, the driving apparatus comprising:

a pair of drive means each of which includes an actuator for displacing a corresponding one of said main pressers along said directional line independently of the other of said main pressers, said actuator being controllable to be stopped at a desired operational position;

input means for inputting data related to a thickness of said binding cloth;

control command producing means for producing, based on the inputted thickness-related data, a control command for each of the two actuators of said pair of drive means; and control means for driving said each of the two actuators according to the produced control command and thereby displacing a corresponding one of said two main pressers along said directional line to a position corresponding to said produced control command.

17. A main-presser driving apparatus according to claim 16, wherein said control command producing means comprises needle distance specifying means for specifying a distance between said two sewing needles, said control command producing means producing said control command based on said inputted thickness-related data and the specified needle distance.

18. A main-presser driving apparatus according to claim 16, wherein said control command producing means comprises:

determining means for determining, based on said inputted thickness-related data, a position to which said each of said two main pressers is to be displaced; and modifying means for modifying the determined position of said each main presser, said control means driving the actuator corresponding to said each main presser so as to displace said each m in presser to the modified position.

* * * * *